United States Patent [19]

Johnson

[11] Patent Number: 4,527,458

[45] Date of Patent: Jul. 9, 1985

[54] TURRET DRIVE SYSTEM FOR ARMORED VEHICLE

[75] Inventor: D. Dale Johnson, Mt. Clemens, Mich.

[73] Assignee: Ex-Cell-O Corporation, Troy, Mich.

[21] Appl. No.: 530,940

[22] Filed: Sep. 12, 1983

[51] Int. Cl.[3] ..... F41F 21/14

[52] U.S. Cl. ..... 89/41.01; 74/425; 74/665 C; 192/8 R

[58] Field of Search ..... 74/665 C, 425; 89/41 R, 89/41 M, 41 H; 192/7, 8 R, 15

[56] References Cited

U.S. PATENT DOCUMENTS 3,429,222 2/1969 Whiston et al. ..... 89/41 R

FOREIGN PATENT DOCUMENTS 259951 8/1927 United Kingdom ..... 89/41 R

*Primary Examiner*—Stephen C. Bentley

*Attorney, Agent, or Firm*—John C. Evans

[57] ABSTRACT

A manual drive system for a turret includes a manually operated drive train for traversing the turret including two synchronizing bevel gears and two spur gears selectively engaged to transfer torque to a horizontal ring gear for rotating the turret and selectively disengaged to back drive a worm gear with respect to a lock worm that locks the turret in a predetermined traverse position.

3 Claims, 2 Drawing Figures

TURRET DRIVE SYSTEM FOR ARMORED VEHICLE

FIELD OF THE INVENTION

This invention relates to turret drive systems and more particularly to manual drive systems for rotating a turret and for preventing turret rotation when an electrical drive system has its power off.

DESCRIPTION OF THE PRIOR ART

Armored vehicles have cupola and weapon mounted on a turret which is driven by an automatic electrically energized power system without use of manual force. Such systems have a manually operated back-up drive unit which enables the turret to be traversed by rotation of the turret through a horizontal internal ring gear on the cupola. One such manually operated drive unit is shown in U.S. Pat. No. 3,429,222 issued Feb. 25, 1969 for Drive Means for Cupola of Tank Vehicle. The manual drive includes a manual input operative when power is removed from an automatic, powered drive motor. During a manual mode of operation a lock spindle is operated separately of the manual drive train to lock the cupola in a manually adjusted position to prevent cupola rotation after manual adjustment of the traverse position.

An object of the present invention is to provide a manual drive for use in conjunction with a power driven system wherein the manual drive includes lock gear components operative to permit transfer of manual drive torque from the input to the output of the manual drive system and the lock gear components being back driven when the input to output gear train is disengaged to produce a built-in lock against rotation of a driven turret or cupola caused by externally applied forces.

Another object of the present invention is to provide a manually operated drive device for a cupola or turret having a horizontal internal ring gear wherein the drive device includes a manually driven pair of synchronizing bevel gears selectively coupled to a worm and worm gear for selectively locking the cupola or turret in a manually adjusted position against externally imposed forces when turret power is off and the manual drive device is not being used.

Still another object of the present invention is to provide a manually operated drive device of the type set forth in the preceding object wherein a manual input is coupled to both the two synchronizing bevel gears and two spur gears to synchronize the spur gears with the lock worm gear and worm when the manual drive device is transferring torque from input to output and wherein the manual input is operative to disengage the bevel gears from the lock worm gear and worm to cause them to lock the output when the manual drive system is not in use.

Figure 1:
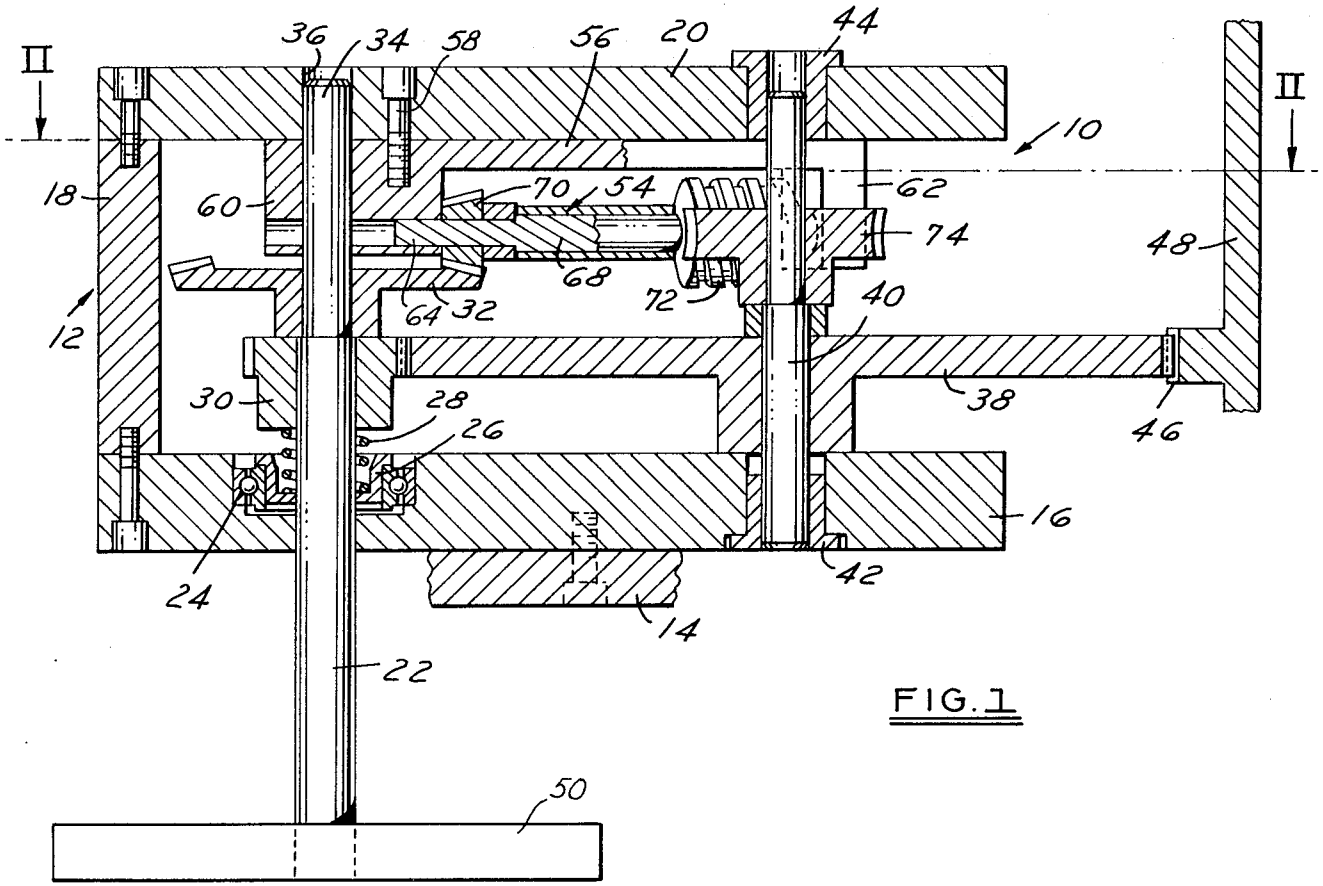
Figure 2:
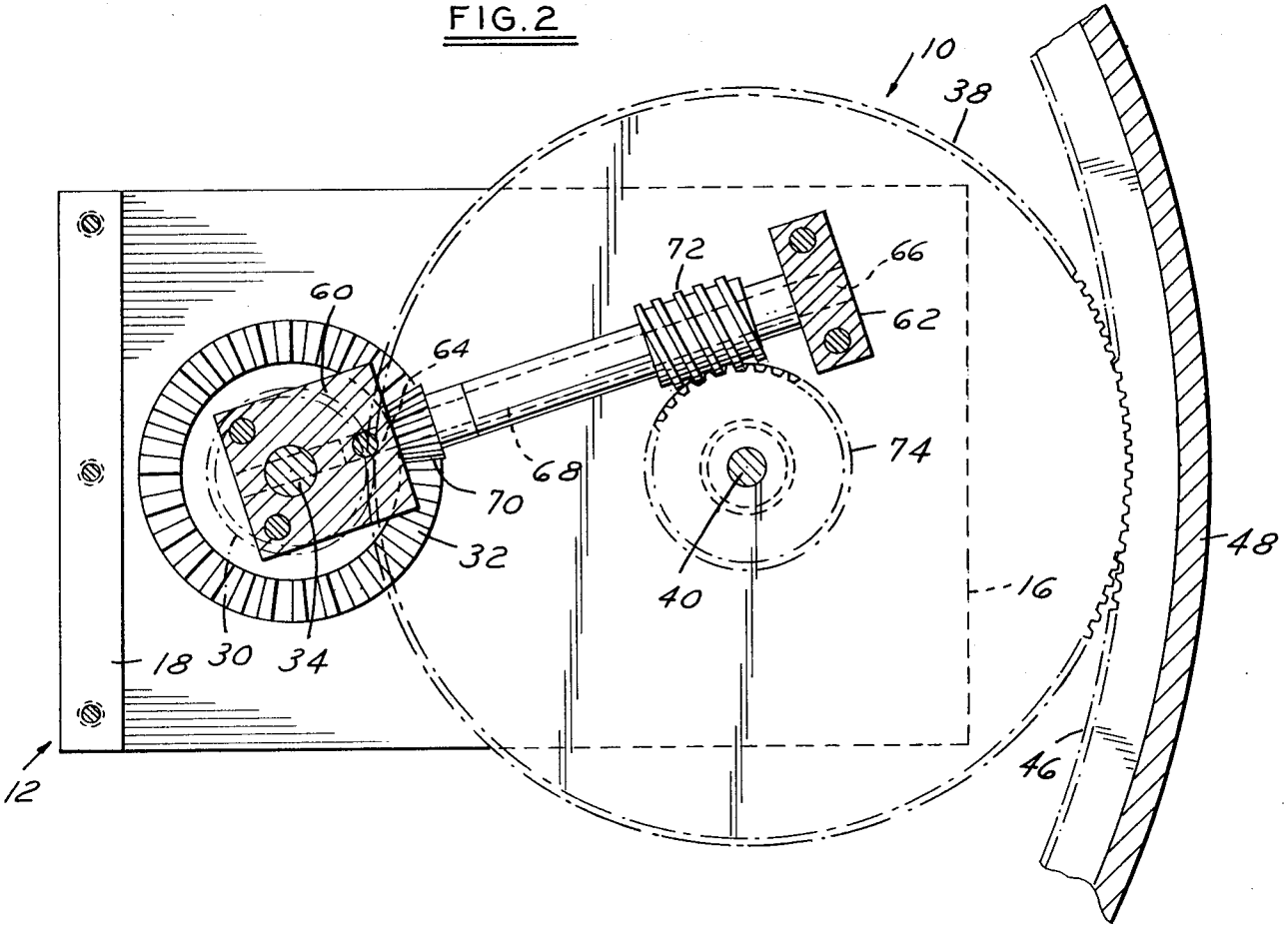

These and other objects of the present invention will be more apparent with reference to the following description and drawings of a preferred embodiment of the invention wherein:

FIG. 1 is a cross-sectional view of a manual drive device including the present invention; and FIG. 2 is a sectional view taken along the line 2—2 of FIG. 1 looking in the direction of the arrows.

Referring now to FIG. 1, a manual turret drive assembly 10 is shown which includes a housing 12 that is connected to a hull base plate 14. The housing 12 includes a lower bearing plate 16, a vertical plate 18 and an upper bearing plate 20.

A manual drive shaft 22 extends through the plate 16 and is supported by a roller bearing 24 that carries a spring cup 26 for a gear engage spring 28. The spring 28 is held between the cup 26 and a spur gear input 30 secured to shaft 22. The shaft 22 also has a synchronizing bevel gear input 32 converted thereto. The bevel gear input 32 is located on shaft 22 immediately above spur gear input 30. The upper end 34 of shaft 22 is piloted in a hole 36 in upper bearing plate 20 to locate the shaft vertically within housing 12.

A drive path is defined between spur gear input 30 and a meshing spur gear output 38 that is connected for rotation with a vertical shaft 40 having its opposite ends supported by sleeve bearings 42, 44 located in plates 16, 20 respectively.

The spur gear output 38 is meshed with a horizontal internal ring gear 46 of a cupola or turret 48. As a result, rotation of an input handle 50 on shaft 22 manually rotates the cupola or turret 48 when the spur gear input 30 and bevel gear input 32 are in the solid-line engaged position. In this position the spring 28 is extended.

The handle 50 has a disengaged position, assumed when the manual turret drive assembly 10 is not in use, at which time the spring 28 is compressed by manual movement of the shaft 22 and handle outboard of housing 12. In the disengaged position, bevel gear input 32 is disconnected from a lock-up gear train 54.

The lock-up gear train 54 includes a support plate 56 secured to upper bearing plate 20 by screws 58. Plate 56 includes spaced dependent ends 60, 62 which support opposite ends 64, 66 of a gear element 68 having a synchronizing bevel output gear 70 on end 64 and a worm 72 at the end 66. The worm 72 meshes with a worm gear 74 that is fixed to shaft 40 for rotation with spur gear output 38.

When the shaft 22 is in its drive engaged position, bevel gear input 32 is engaged, the bevel gears 32, 70 synchronize the lock-up gear train mesh with the spur gear drive and the worm 72 and worm gear 74 rotate passively as the spur gear output 38 is freely driven by rotation of handle 50 to produce manual drive of ring gear 46 and its cupola or turret 48.

When the handle 50 is in its disengaged position, spur gear 30 and bevel gear 32 are moved until bevel gear 32 is disengaged from bevel gear 70. Under this condition the lock-up gear train 54 is no longer synchronized with the spur gear drive train.

Heretofore, when turret power is off to an associated power drive of a known type and when the manual drive is not operated, turrets could be rotated by externally applied forces on the turret unless a separate lock was manually positioned. In accordance with the present invention such externally applied forces are automatically resisted as follows. If a torque is applied to the turret 48, the spur gear output 38 will back drive the worm gear 74 against the worm 72 to lock the output 38 in its prior adjusted position.

While the embodiment of the present invention, as herein disclosed, constitutes a preferred form, it is to be understood that other forms might be adapted.

I claim:

1. In an armored vehicle having a turret and a ring gear connected to the turret; a manually operated auxiliary drive having a first gear train having an input and an output for manually driving the ring gear, gear lock-up train means including synchronizing gear means synchronizing drive of the lock-up train with the first gear train for producing free transfer of torque from the input to the output of said first gear train, and means including a gear engage spring that is compressed to de-couple said synchronizing gear means from said first gear train when said manually operated drive is not in use, said gear lock-up train means having its synchronizing gear means back driven in responsive to externally applied forces on the turret to lock the output of said first train when said synchronizing gear means are de-coupled to prevent the turret from rotating when externally applied forces are imposed thereon.

2. In the combination of claim 1, said first drive train including an input shaft, a spur gear input connected for rotation with said shaft and a spur gear output meshed with said spur gear input and said ring gear.

3. In an armored vehicle having a turret and a ring gear connected to the turret; a manually operated auxiliary drive having a first gear train having an input and output for manually driving the ring gear, gear lock-up train means including synchronizing gear means synchronizing drive of the lock-up train with the first gear train for producing free transfer of torque from the input to the output of said first gear train, and means for de-coupling said synchronizing gear means when said manually operated drive is not in use, said gear lock-up train means including means responsive to externally applied forces on the turret to lock the output of said first train when said synchronizing gear means are de-coupled to prevent the turret from rotating when externally applied forces are imposed thereon, said lock-up gear train including two synchronizing bevel gears, and a worm and worm gear, said de-coupling means including a manually driven reciprocating shaft coupled to the input of said first gear train and to one of said bevel gears having engaged and disengaged positions, said worm and worm gears being operatively connected to the output of said first gear train, said bevel gears synchronizing the mesh of said first gear train and said lock-up gear train when the shaft is in its engaged position, said lock-up gear train locking the output of said first gear train when said shaft is in its disengaged position.

* * * * *